US007044337B1

(12) United States Patent
Kou

(10) Patent No.: US 7,044,337 B1
(45) Date of Patent: May 16, 2006

(54) UNCLOGGING DEVICE HAVING SAFETY CAP

(76) Inventor: Min-Lan Kou, 12019 Carlsbad Dr., Austin, TX (US) 78738

( * ) Notice: Subject to any disclaimer, the term of this patent is extended or adjusted under 35 U.S.C. 154(b) by 12 days.

(21) Appl. No.: 10/975,484

(22) Filed: Oct. 29, 2004

(51) Int. Cl.
*B67B 5/00* (2006.01)

(52) U.S. Cl. ..... 222/153.11; 222/182; 222/402.13

(58) Field of Classification Search ..... 222/153.01, 222/153.04, 153.11, 153.1, 153.14, 182–183, 222/402.1, 562, 402.13, 402.23, 402.25; 215/316–318, 321
See application file for complete search history.

(56) References Cited

U.S. PATENT DOCUMENTS 4,204,615 A * 5/1980 McCarthy ..... 222/153.14
4,353,483 A * 10/1982 Pehr ..... 222/153.02
4,944,429 A * 7/1990 Bishop et al. ..... 222/153.13
6,302,302 B1 * 10/2001 Albisetti ..... 222/153.11
6,758,373 B1 * 7/2004 Jackson et al. ..... 222/153.11

* cited by examiner

*Primary Examiner*—Frederick C. Nicolas
(74) *Attorney, Agent, or Firm*—Rosenberg, Klein & Lee

(57) ABSTRACT

An unclogging device includes a support member securely mounted to the can and a cap rotatably mounted to the support member. The cap includes two flexible portions on the peripheral wall thereof and first and second protrusions extend from each of the flexible portions. The support member includes two first notches for engaging one of the first protrusions and two second notches which are deeper than the first notches so as to allow the first protrusions to be moved therein after the support member is rotated an angle relative to the cap. By the arrangement, the users have rotate the support member together with the can relative to the cap before the nozzle on the can is pushed by the cap to eject the pressurized air in the can from the nozzle to clean the clogged drains.

7 Claims, 8 Drawing Sheets

UNCLOGGING DEVICE HAVING SAFETY CAP

FIELD OF THE INVENTION

The present invention relates to an unclogging device that has a safety cap so as to prevent unintentional activation of the pressurized unclogging device.

BACKGROUND OF THE INVENTION

A conventional unclogging device for removing obstructions from drains or the like is disclosed in FIGS. 6 and 7, and generally includes a can 60 in which pressurized air is stored and a nozzle 61 is connected to an end of the can 60. A cylindrical cap 62 is mounted to the can 60 and includes a tube 63 which connected to a distal end of the nozzle 61. A spring 64 is mounted to the tube 63 and biased between the can 60 and a wall connected to the tube 63. When pushing the can 60 upside down and pressing the cap 62 against the drain hole, the user presses the can 60 toward the cap and the nozzle 61 is pressed by the stationary tube 63 so that high pressurized air injects into the drain to remove the obstructions which can be flushed away. The device has not any safety device to prevent children from unintentionally pressing the can 60 and the sudden and high pressurized air could injure the children.

The present invention intends to provide a safety cap used for the unclogging device and the cap can only pressed when the cap is rotated an angle.

SUMMARY OF THE INVENTION

The present invention relates to an unclogging device which includes a can having a nozzle and a support member is mounted to the can and has a peripheral wall which includes two first notch and two second notches defined in a top edge thereof. A depth of each of the second notches is deeper than that of each of the first notches. A separation plate is transversely connected to an inner periphery of the peripheral wall and a central hole is defined through the separation plate so that the nozzle extends through the central hole. A cap has an open top and an end plate is connected to an inner periphery of the open top. An outer wall is connected to a top edge of the inner periphery of the open top so as to define an annular gap between the inner periphery of the open top and the outer wall. The peripheral wall of the support is inserted into the annular gap. A tubular portion extends from an underside of the end plate and a passage is defined through the tubular portion. An enlarged chamber is defined in an inner periphery of the passage and the nozzle is engaged with the enlarged chamber. Two flexible portions are split from the outer wall and each flexible portion includes a first protrusion extending radially from the flexible portion. The two first protrusions are alternatively engaged with the first and second notches by pressing the first protrusions inward to disengage from the first notches and then rotating the support member relative to the cap to engage the first protrusions with the second notches.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
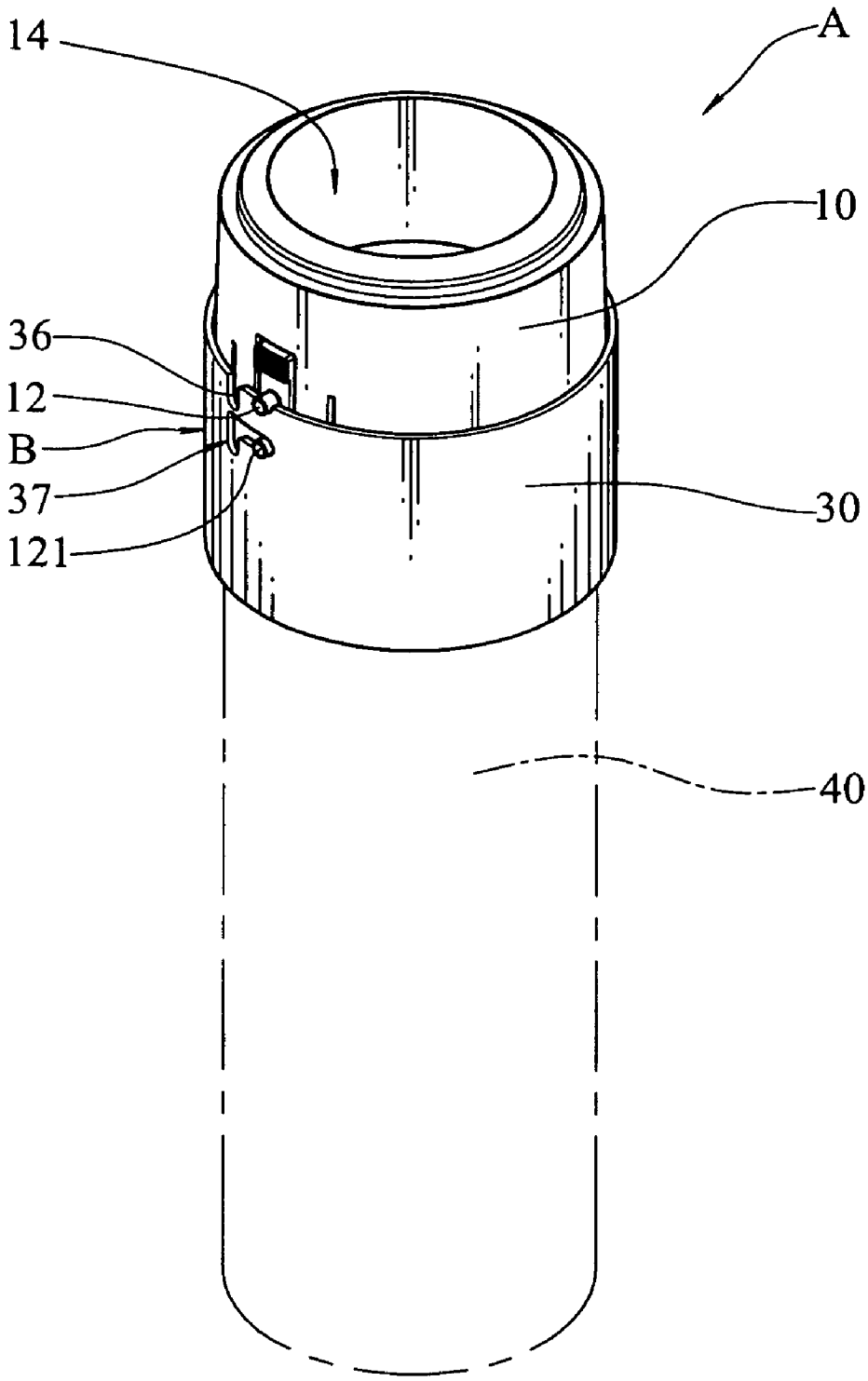
FIG. 1 is a perspective view to show the unclogging device of the present invention.
Figure 2:
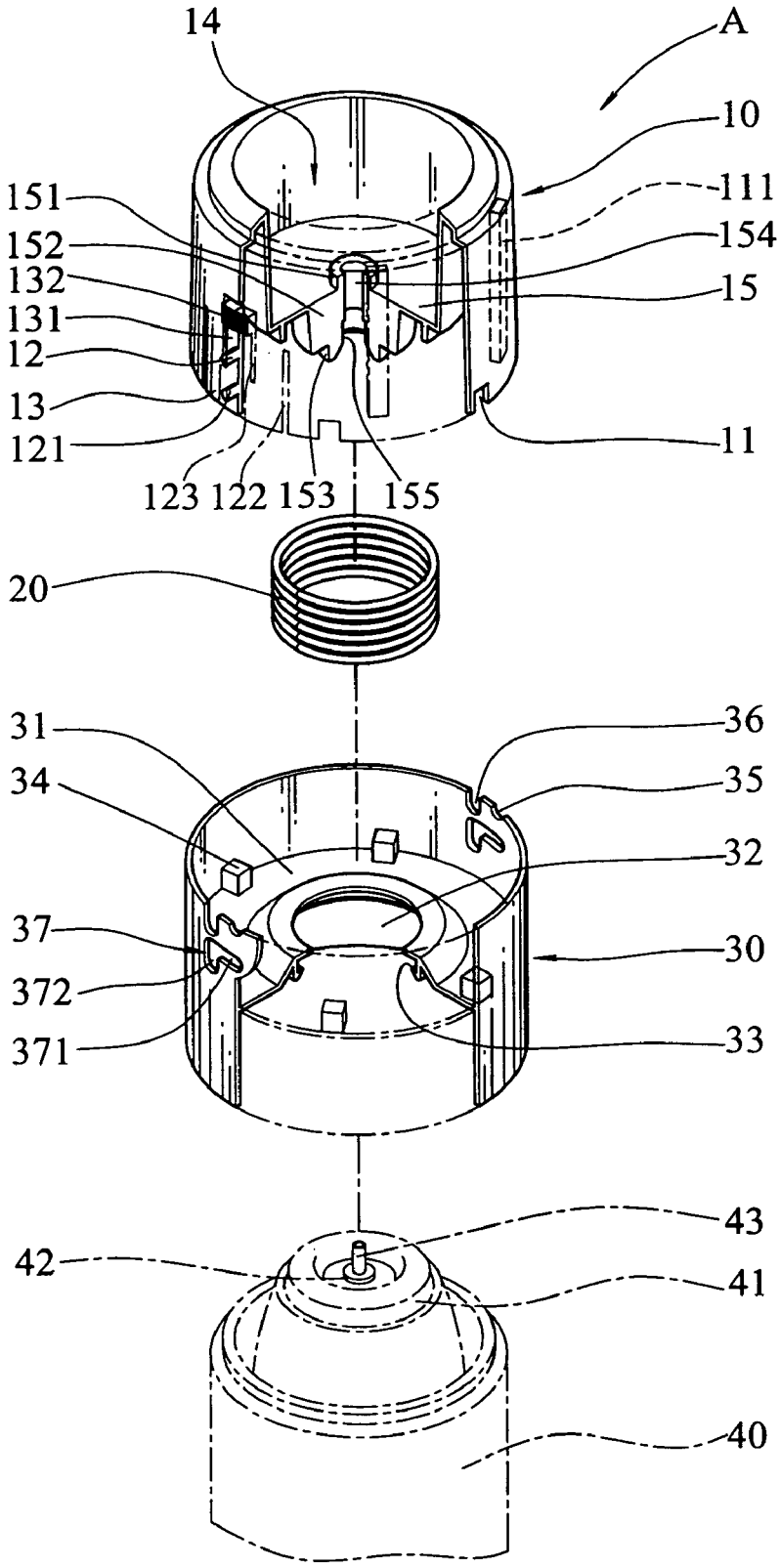
FIG. 2 is an exploded view to show the unclogging device of the present invention.

Referring to FIGS. 1, 2, 3, 4A and 4B, the unclogging device "A" of the present invention comprises a can 40 having a nozzle 43 extending from a base 42 on an end surface of the can 40 and pressurized air or cleaning agent is received in the can 40.

A support member 30 is securely mounted to the can 40 and has a peripheral wall which includes two first notch 35 and two second notches 36 defined in a top edge thereof. A depth of each of the second notches 36 is deeper than that of each of the first notches 35. Two L-shaped holes 37 are defined in the peripheral wall of the support member 30 and located beneath the second notches 36. Each L-shaped hole 37 includes a horizontal slot 371 and a vertical slot 372 which is in alignment with the second notch 36 corresponding thereto. A separation plate 31 is transversely connected to an inner periphery of the peripheral wall and a central hole 32 is defined through the separation plate 31 so that the nozzle 43 extends through the central hole 32. The separation plate 31 includes an annular hook 33 extending from an underside thereof and the can 40 includes an annular lip 41 with which the annular hook 33 is hooked. A plurality of blocks 34 extend from a top of the separation plate 31.

A cap 10 has an open top 14 and an end plate 15 is connected to an inner periphery of the open top 14. An outer wall is connected to a top edge of the inner periphery of the open top 14 so as to define an annular gap between the inner periphery of the open top 14 and the outer wall. The peripheral wall of the support 30 being inserted into the annular gap. A tubular portion 152 extends from an underside of the end plate 15 and a passage 154 is defined through the tubular portion 152. A tubular lip 151 extends from the end plate 15 and encloses the opening defining by the passage 154. An annular portion 153 extends from a distal end of the tubular portion 152 and encloses an enlarged chamber 155 defined in an inner periphery of the passage 154. The nozzle 43 is engaged with the enlarged chamber 155 and the annular portion 153 is rested on the base 42 from which the nozzle 43 extends. A spring 20 is mounted to the tubular portion 152 and biased between the separation plate 31 and the end plate 15.

Figure 3:
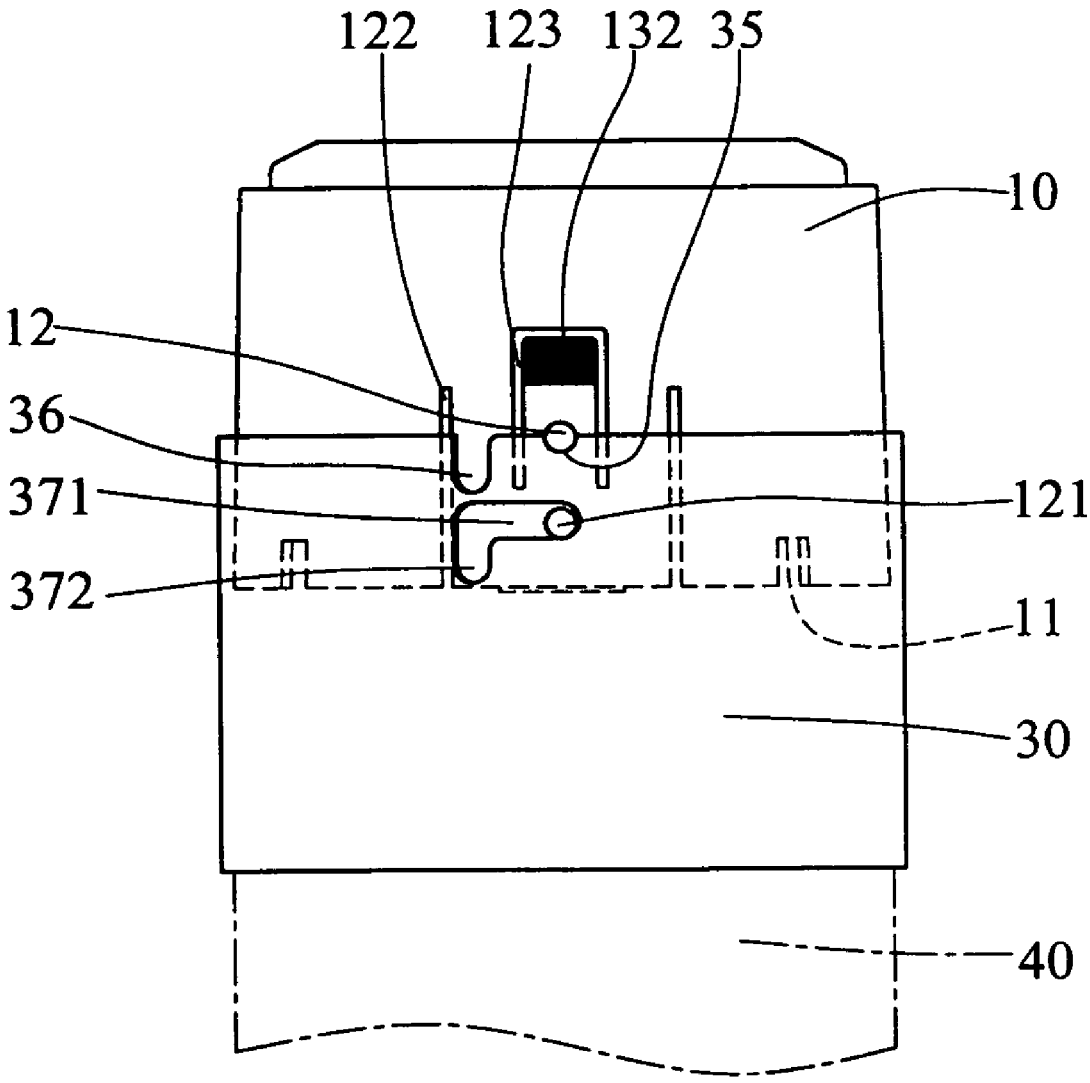
FIG. 3 shows that the first protrusion is engaged with the first notch in the support member so that the nozzle is not able to be pressed.
Figure 4A:
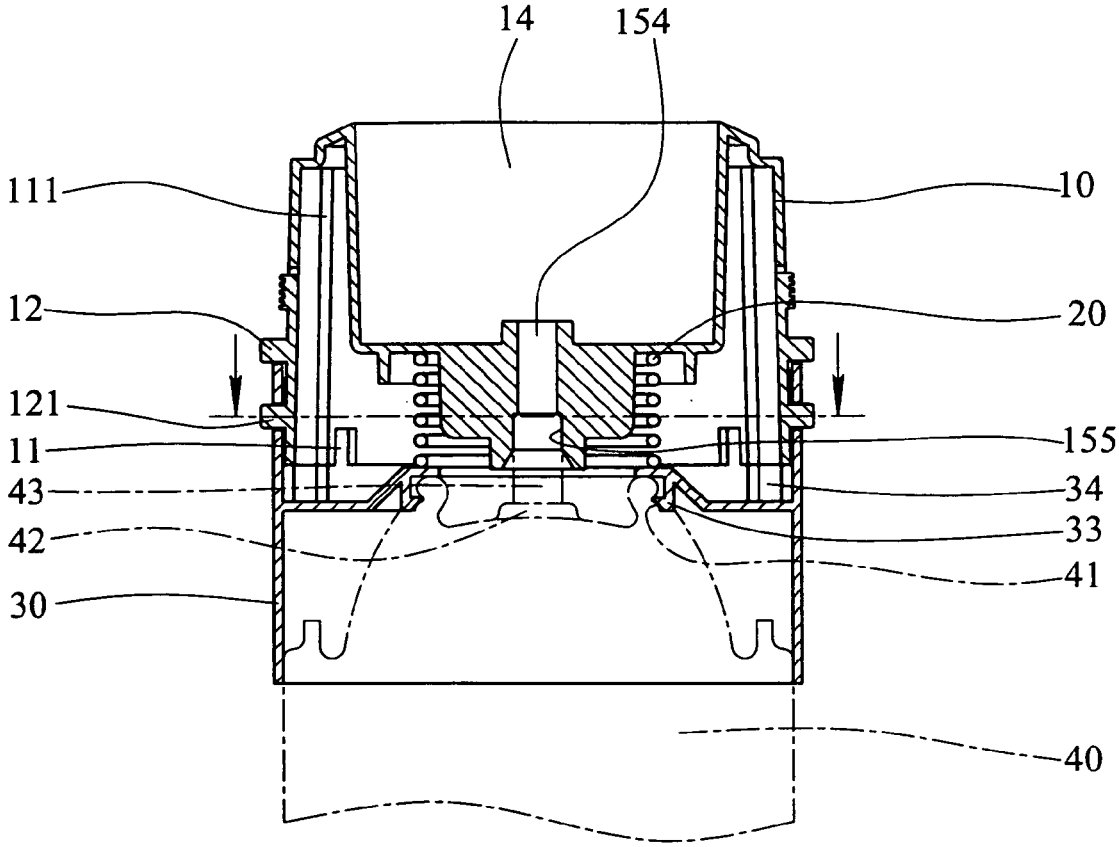
FIG. 4A is a cross sectional view to show a cross sectional view when the first protrusion is engaged with the first notch in the support member.
Figure 4B:
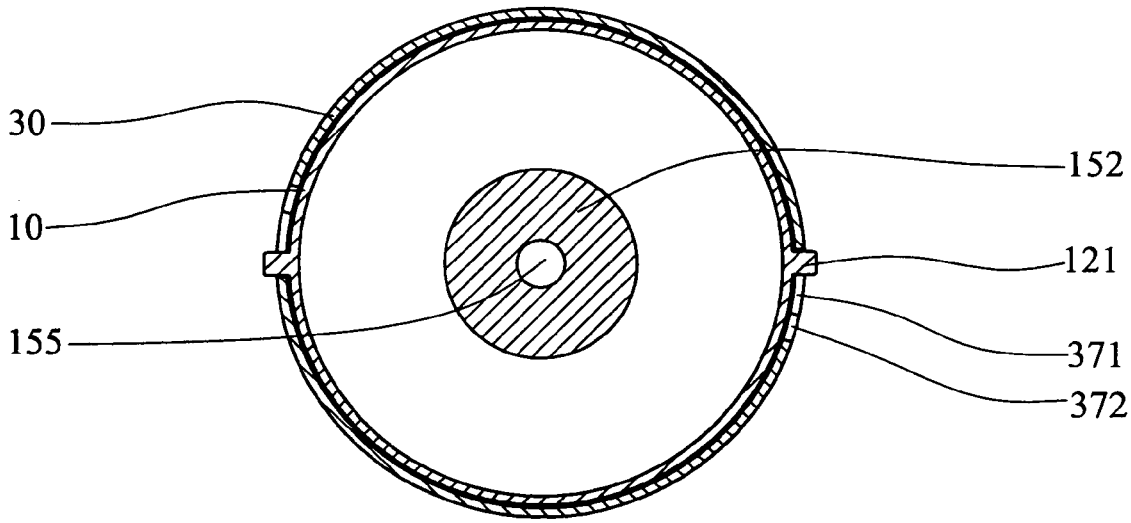
FIG. 4B is a top cross sectional view to show that the first protrusion is engaged with the first notch in the support member.
Figure 4C:
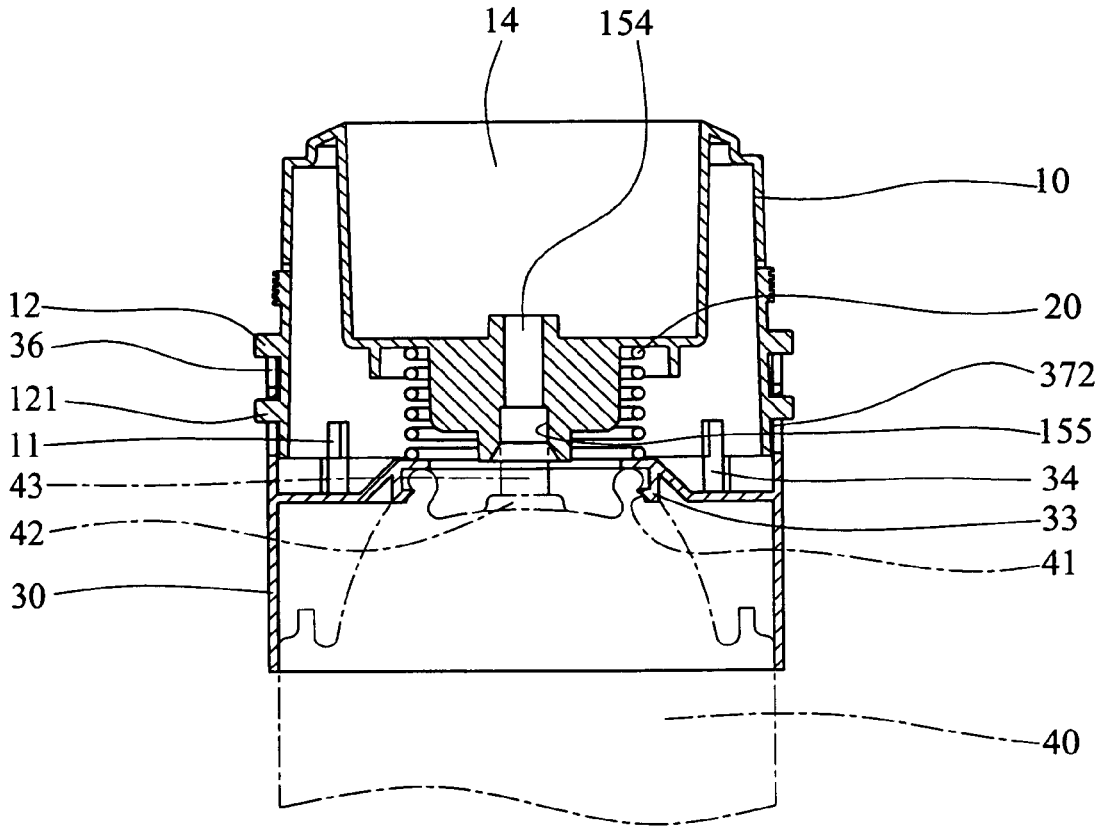
FIG. 4C is a cross sectional view to show a cross sectional view when the first protrusion is engaged with the second notch in the support member.
Figure 4D:
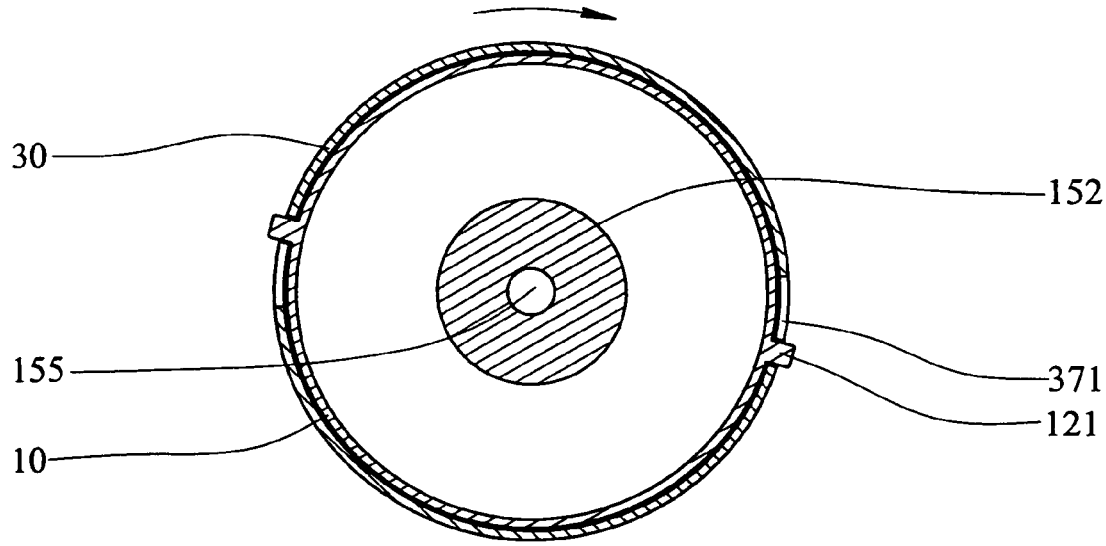
FIG. 4D is a top cross sectional view to show that the first protrusion is engaged with the second notch in the support member.
Figure 4E:
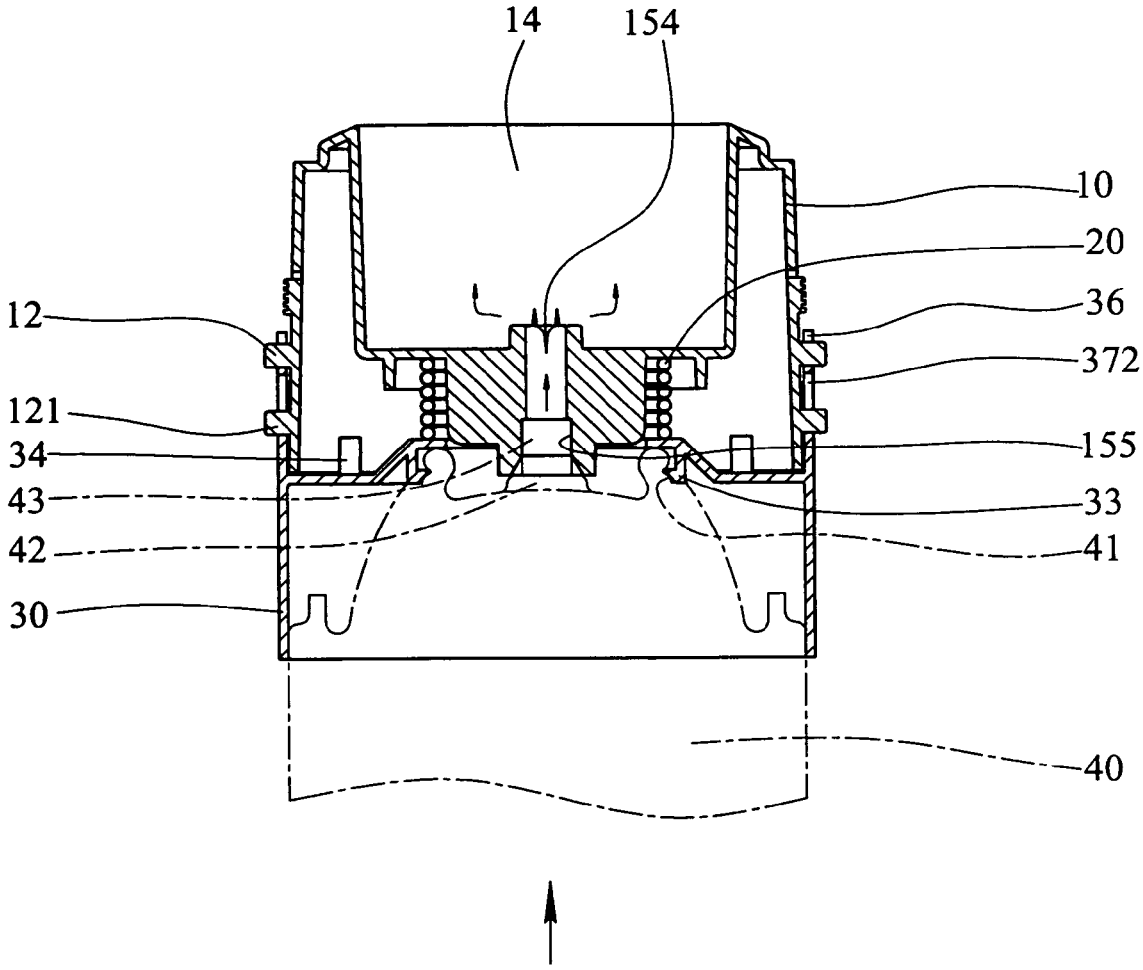
FIG. 4E shows that the nozzle is pressed to release pressurized air in the can form the nozzle.
Figure 5:
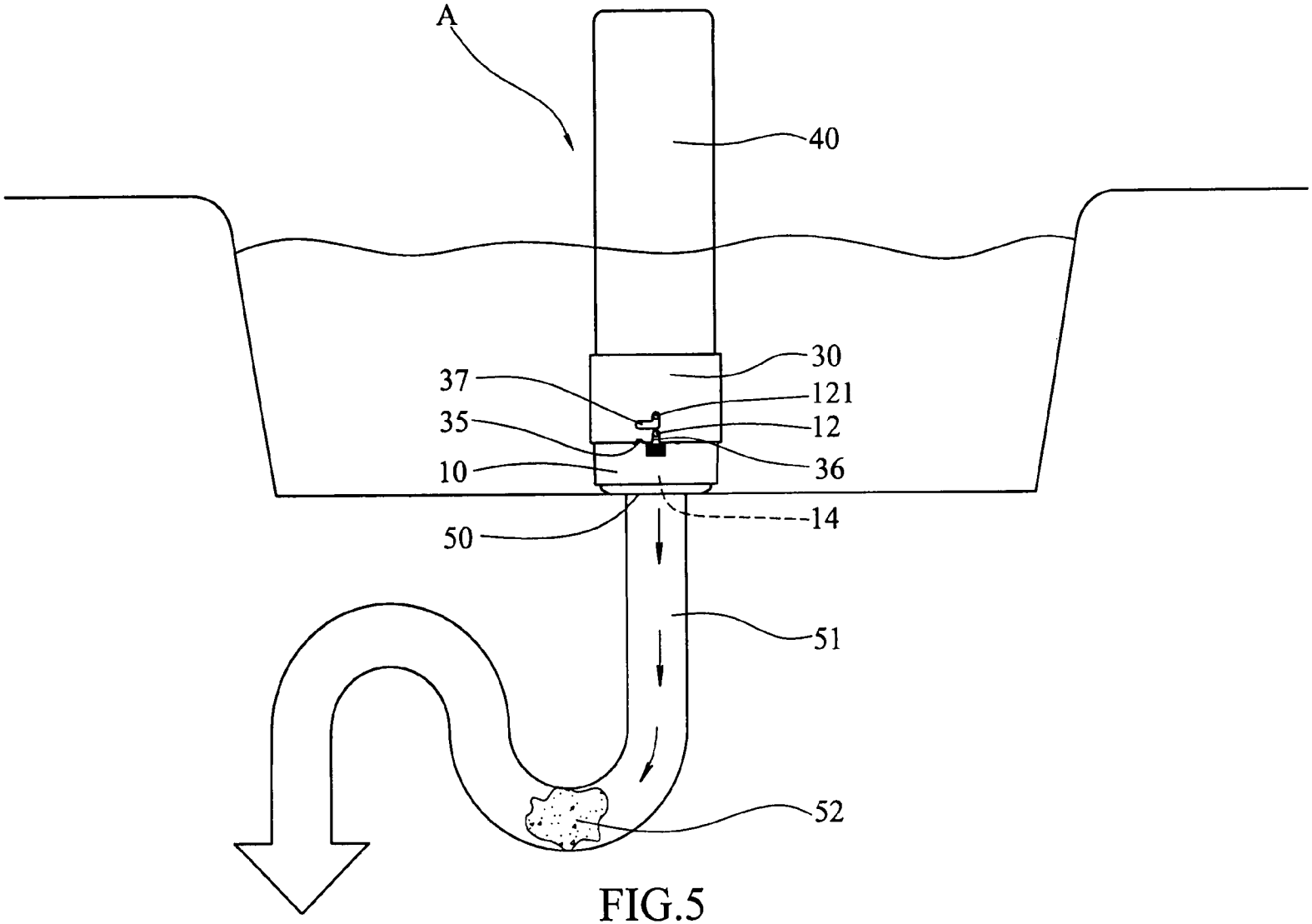
FIG. 5 shows that the pressurized air removes the obstruction in the drain.
Figure 6:
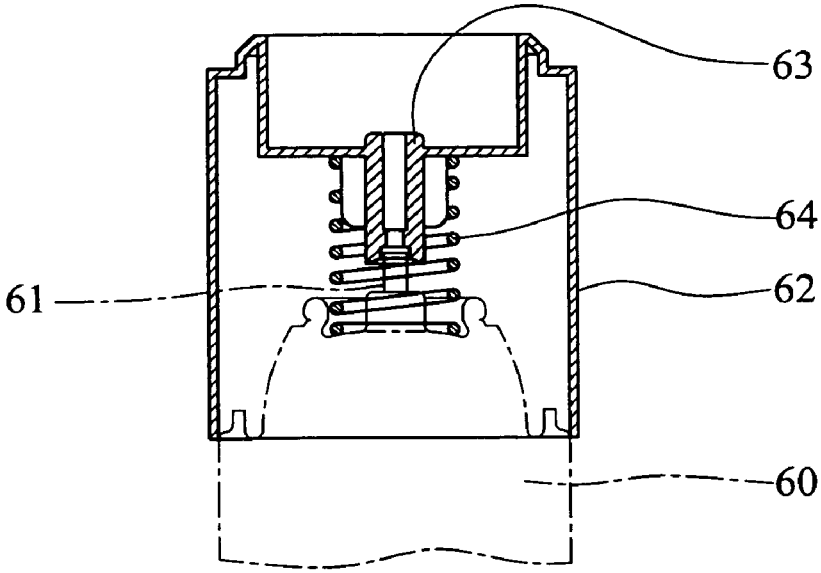
FIG.6 PRIOR ART
FIG. 6 shows a conventional unclogging device.
Figure 7:
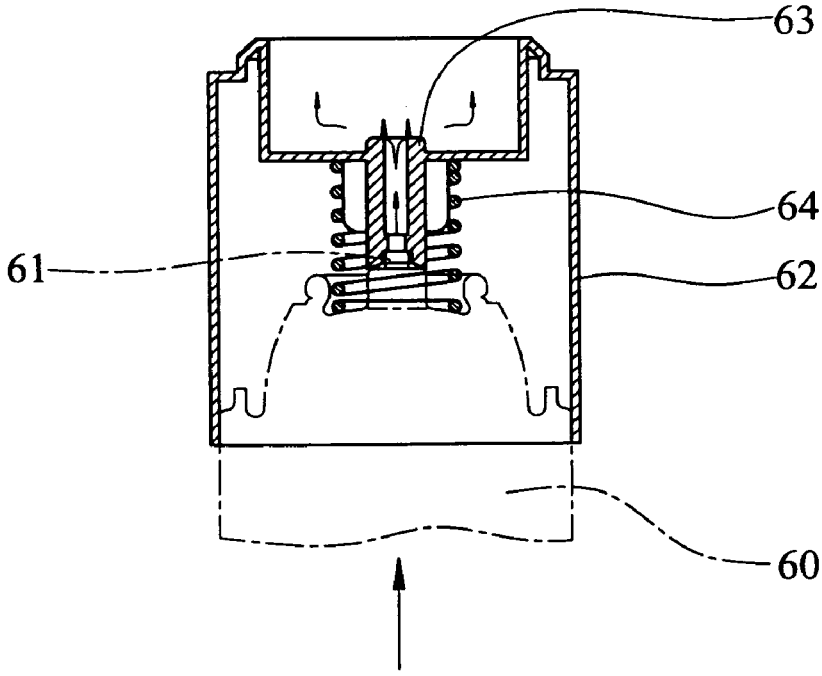
FIG.7 PRIOR ART
FIG. 7 shows that the conventional unclogging device is in action.

Two flexible portions 13 split from the outer wall and defining by two U-shaped slits 123 defined through the outer wall of the cap 10. Each flexible portion 13 includes a first protrusion 12 and a second protrusion 121 extending radially from the flexible portion 13. Two pairs of slots 122 are defined through the outer wall of the cap 10 and each flexible portion 13 is located between respective one of the two pairs of slots 122 so as to provide the flexible portions 13 a better flexibility. A rough surface 132 is defined in an outer surface of each of the flexible portions 13 so that the users easily push the flexible portions 13 inward. As shown in FIG. 3, the two first protrusions 12 are engaged with the first notches 35 when the device is not in use. The second protrusions 121 are engaged with respective one of the horizontal portions 371 of the two L-shaped holes 37 in the peripheral wall of the support member 30. A plurality of ribs 111 extend from an inner periphery of the outer wall of the cap 10 and the ribs 111 are rested on the blocks 34 to prevent the support member 30 from being pushed toward the cap 10. Besides, the first protrusions 12 are restricted in the first notches 35 and the second protrusions 121 are limited in the horizontal portions 371, so that when the device is not in use, the cap 10 is positioned such that the cap 10 and the support member 30 cannot have relative movement toward each other.

The outer wall of the cap 10 has a plurality of recesses 11 defined in an lower edge thereof and the blocks 34 are engaged with the recesses 11 when the support member 30 is rotated an angle relative to the cap 10 and pushed toward the cap 10.

Referring to FIGS. 4C to 4E and FIG. 5, when in use, the cap 10 is pushed against the inside of the sink and the open top 14 is in alignment with the opening of the drain 51 in the inside of the sink. The flexible portions 13 are pushed inward to remove the first protrusions 12 from the first notches 35, and the can 40 together with the support member 30 are rotated an angle to engage the first protrusions 12 with the second notches 36, and the second protrusions 121 are shifted to the vertical portions 371 of the L-shaped slots 37. The can 40 then pushed toward the cap 10 such that the nozzle 43 is pushed and the pressurized air is released from the nozzle 43 and enters the drain 51 to move the obstruction 52 away.

While we have shown and described the embodiment in accordance with the present invention, it should be clear to those skilled in the art that further embodiments may be made without departing from the scope of the present invention.

What is claimed is:

1. An unclogging device comprising:

a can having a nozzle extending from a base on an end surface of the can;

a support member mounted to the can and having a peripheral wall which includes two first notch and two second notches defined in a top edge thereof, a separation plate transversely connected to an inner periphery of the peripheral wall, a depth of each of the second notches being deeper than that of each of the first notches, a central hole defined through the separation plate and the nozzle extending through the central hole, and a cap having an open top and an end plate connected to an inner periphery of the open top, an outer wall connected to a top edge of the inner periphery of the open top so as to define an annular gap between the inner periphery of the open top and the outer wall, the peripheral wall of the support being inserted into the annular gap, a tubular portion extending from an underside of the end plate and a passage defined through the tubular portion, an enlarged chamber defined in an inner periphery of the passage and the nozzle engaged with the enlarged chamber, two flexible portions split from the outer wall and each flexible portion including a first protrusion extending radially from the flexible portion, the two first protrusions alternatively engaged with the first and second notches by pressing the first protrusions inward to disengage from the first notches and then rotating the support member relative to the cap to engage the first protrusions with the second notches.

2. The device as claimed in claim 1, wherein a plurality of blocks extend from a top of the separation plate and a plurality of ribs extend from an inner periphery of the outer wall of the cap, the ribs rested on the blocks to prevent the support member from being pushed toward the cap.

3. The device as claimed in claim 1, wherein a plurality of blocks extend from a top of the separation plate and the outer wall of the cap has a plurality of recesses defined in an lower edge thereof, the blocks being engaged with the recesses when the support member is rotated an angle relative to the cap and pushed toward the cap.

4. The device as claimed in claim 1, wherein the separation plate includes an annular hook extending from an underside thereof and the can includes an annular lip with which the annular hook is hooked.

5. The device as claimed in claim 1, wherein each of the flexible portions has a second protrusion extending therefrom which is engaged with respective one of two L-shaped holes in the peripheral wall of the support member.

6. The device as claimed in claim 1, wherein a spring is mounted to the tubular portion and biased between the separation plate and the end plate.

7. The device as claimed in claim 1, wherein each of two flexible portions is defined by a U-shaped slit defined through the outer wall of the cap.

* * * * *